United States Patent [19]

Zavodny

[11] 4,016,811

[45] Apr. 12, 1977

[54] GROOVED ROLLER DAMPENER

[75] Inventor: Eugene N. Zavodny, Riverside

[73] Assignee: Rockwell International Corporation, Pittsburgh, Pa.

[22] Filed: Aug. 20, 1975

[21] Appl. No.: 606,113

[52] U.S. Cl. ..... 101/148; 29/121.1; 101/132.5

[51] Int. Cl.[2] ..... B41F 7/24

[58] Field of Search ..... 101/132.5, 147, 148, 101/451, 350, 364; 29/121 R, 121 H, 127, 128

[56] References Cited

UNITED STATES PATENTS

| | | | |
|---|---|---|---|
| 2,051,222 | 8/1936 | Odell | 29/121 H |
| 2,338,635 | 1/1944 | Galber | 29/121 H |
| 2,530,282 | 11/1950 | Brodie et al. | 101/350 |
| 3,008,407 | 11/1961 | Roberts et al. | 101/148 |
| 3,106,154 | 10/1963 | Saul | 101/147 X |
| 3,285,169 | 11/1966 | Hartwig | 101/350 X |
| 3,613,575 | 10/1971 | Kantor | 29/121 R |
| 3,705,451 | 12/1972 | Dahlgren | 101/148 X |

*Primary Examiner*—Edgar S. Burr
*Assistant Examiner*—R. E. Suter

[57] ABSTRACT

The invention pertains to an improved transfer roller for use in continuous type dampening mechanisms for lithographic offset printing presses. The surface of the transfer roller is provided with minute, closely spaced, spiral grooves whereby the fluid feed capacity of such dampeners is significantly increased so as to satisfy the dampening requirements of high speed lithographic web presses.

2 Claims, 3 Drawing Figures

GROOVED ROLLER DAMPENER

BACKGROUND OF THE INVENTION

Although continuous type dampeners have been known and used successfully for quite some time, their use has been limited primarily to sheet and web fed offset commercial type printing presses which operate at relatively low speeds and which print on specially coated offset paper stock. Attempts to employ these dampening mechanisms on high speed web offset newspaper presses, however, have been for the most part unsuccessful. The lack of success is due primarily to the inability of the conventional transfer roller, which has a smooth, continuous, highly polished surface, to feed sufficient water to the plate at high press speeds to compensate for the highly absorbent nature of newsprint paper.

Merely increasing the surface speeds and/or varying the slip ratios of the coacting dampening rollers proved not to be the solution. Such changes tended to create excessive turbulence of the fluid in the fountain and the dampening function became progressively more erratic and inconsistent as the press speeds approached the upper, normal operating ranges. For the most part, therefore, it has been necessary to operate such presses below their rated speeds or to use ductor or brush type dampeners.

SUMMARY OF THE INVENTION

The present invention has succeeded in significantly increasing the overall dampening fluid feed capacity of continuous type dampeners, while retaining the ability to feed absolute minimum amounts of fluid when necessary, in a relatively simple, economical and yet highly effective manner. In essence it involves replacing the standard transfer roller having a highly polished, smooth, continuous surface with a modified transfer roller having a smooth, but interrupted surface whereby the overall surface area and thus the fluid carrying capacity of the roller is significantly increased. By means of this relatively simple change a significantly increased volume of fluid can be uniformly and consistently transferred to the printing plate to satisfy the maximum demands of web offset newspaper presses when operating in their upper speed ranges. In accordance with the invention, the surface of the transfer roller is provided throughout its entire length with minute, closely spaced, spiral grooves which are formed at a small helix angle. The spiral grooves function as wells or reservoirs whereby a surplus of fluid is presented to the nip of the transfer roller and the coacting form dampening or applicator roller and the precise amount of fluid required to dampen the printing plate can be readily controlled by adjusting the relative surface speeds of the transfer roller and/or the applicator roller.

A secondary advantage of the spiral grooved transfer roller resides in its inherent ability to constantly work and distribute the ink which is unavoidably picked up from the plate and which tends to build up on the surface of the applicator roller. The spiral grooves automatically function to distribute and maintain this ink uniform and level along the entire length of the applicator roller so that it will consistently transfer a thin, uniform film of dampening fluid to the printing plate over extended periods of operation and the need for an auxiliary oscillator roller to perform this function is avoided.

Still another advantage of the spiral grooved transfer roller resides in its capability, in conjunction with the coacting applicator roller, to supply the precise, required amount of dampening fluid to the printing plate throughout a substantial range of press speeds without the need for compensating adjustments of the transfer roller speed.

DETAILED DESCRIPTION OF THE INVENTION

Figure 1:
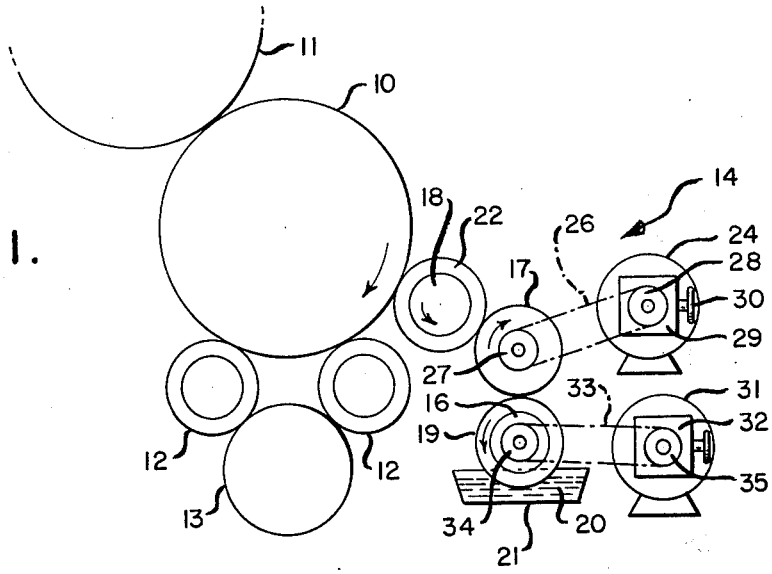
FIG. 1 is a schematic side elevational view of a portion of a lithographic web newspaper printing press embodying the present invention.

With reference now to FIG. 1 of the drawings the invention is illustrated, merely by way of example, as embodied in a unit of a rotary lithographic web offset newspaper printing press wherein its increased dampening fluid feed capacity is particularly advantageous. This is not to be construed as a limitation however, because the invention can be used with advantage on all lithographic presses both sheet and web fed.

As illustrated the newspaper press unit includes a plate cylinder 10 on which the lithographic plate to be printed is mounted, a coacting blanket cylinder 11 for transferring the ink image from the plate to a newsprint web and an inking mechanism which includes form inking rollers 12 and an ink drum 13 for transferring ink from a source thereof to the plate on the plate cylinder. A dampening mechanism, indicated in its entirety by the numeral 14, is adapted to apply a uniform film of dampening fluid to the plate during each cycle of operation and prior to its receiving ink from the form inking rollers 12 as is well known in the art.

The dampening mechanism illustrated is of the continuous duty type and essentially comprises a pan roller 16, a transfer roller 17 and a form dampening or applicator roller 18. These rollers are all suitably journalled for rotation in adjacent side frames and conventional means, not shown, are provided for adjusting the rollers to properly align their axes and to establish the required pressure between the rollers at the respective coacting nips.

The pan roller 16 is adapted to convey a continuous supply of dampening fluid to the transfer roller nip and it is provided with a smooth continuous, resilient surface 19 which is partially immersed in a reservoir of dampening fluid 20 contained in a water pan or fountain 21. The transfer roller 17 is made of metal with its peripheral surface being treated so as to be hydrophilic or water receptive and it normally functions to transfer dampening fluid from the pan roller nip to the applicator roller 18 which is provided with a smooth, continuous, resilient surface 22 and serves to transfer the fluid from the transfer roller nip to the plate cylinder 10.

The applicator roller 18 may be driven by friction from the plate cylinder or through positive drive means to run at the same surface speed as the plate cylinder 10 whereas the transfer roller 17 is driven by independent drive means such as the motor 24 so that its surface speed may be varied to thereby regulate the amount of dampening fluid that is transferred to the applicator roller 18.

While the drive for the transfer roller may take any convenient form, it is illustrated as including a V-belt 26 which is tracked about the respective sheaves 27 and 28 with the sheave 28 being driven by the motor 24 through a variable speed transmission unit 29. A manually adjustable control member 30 is provided on the transmission unit for varying the surface speed of the transfer roller relative to the applicator roller and this control is used to vary the volume of fluid transferred to the applicator roller in accordance with the press speed and plate requirements.

The pan roller 16 also is positively driven at a surface speed related to that of the transfer roller 17 and the drive means may comprise intermeshing gears on the respective roller shafts for driving the pan roller at the same surface speed or at a fixed ratio with respect to the transfer roller. To provide added control flexibility, however, it is preferred to provide independent drive means for the pan roller comparable to that for the transfer roller and, as illustrated, such drive means may comprise a second motor 31, transmission 32, belt 33 and sheaves 34 and 35.

When the press is in operation, the respective cylinders and rollers are rotated in the directions indicated by the arrows and the pan roller functions to pick up a continuous supply of dampening fluid 20 on its peripheral surface as it rotates in the pan 21 and convey the fluid to the nip formed with the transfer roller 17. At this point a metered amount of fluid is transferred to the water receptive surface of the transfer roller 17 whereby it is conveyed to the nip formed between the transfer roller and the applicator roller 18 where the film of fluid, or at least a portion thereof, is transferred to the applicator roller and thence to the plate on the plate cylinder 10.

The overall volume of dampening fluid transferred to the plate varies with relation to the speed of the press and the requirements of a particular plate and may be controlled by adjusting the surface speed of the transfer roller relative to that of the applicator roller. Normally, the surface speed of the transfer roller is substantially less than that of the applicator roller so that there is considerable slippage between the roller surfaces at the transfer/applicator roller nip. Additional volume control can be effected by adjusting the nip pressure between the pan and transfer rollers and/or by varying the surface speed of the pan roller relative to the transfer roller.

In conventional dampeners of the type illustrated it has been considered essential and it has been standard practice to employ transfer rollers which have a highly polished, continuous, uninterrupted surface. This type of roller has been effective for the purpose in commercial type sheet and web fed presses printing on coated stock and which run at speeds that do not exceed about 1000 feet per minute. The maximum fluid feed capacity of such rollers, however, has proved to be inadequate for rotary newspaper presses which operate at speeds up to 2000 feet per minute and print on uncoated newsprint stock. At such high speeds, the absorbent nature of the paper causes the dampening fluid to be absorbed and removed from the blanket and plate at a rapid pace and the smooth transfer roller is incapable of supplying sufficient dampening fluid to compensate therefore, when operating at its maximum permissible surface speed.

The improved transfer roller of the present ivention, which will now be described, has succeeded in overcoming this deficiency and is capable of transferring substantially more fluid, i.e., 50% more, than the conventional transfer rollers while retaining the ability to feed an absolute minimum volume of fluid when required.

Figure 2:
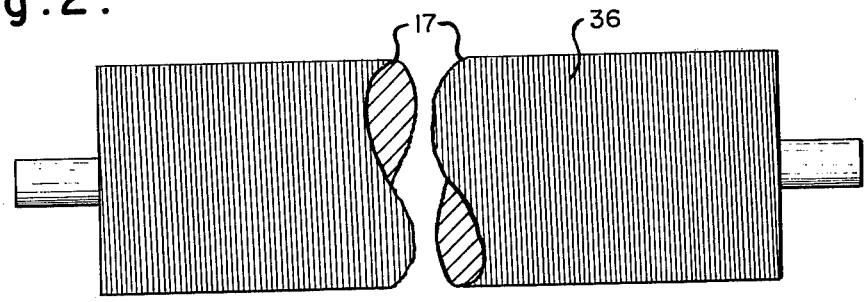
FIG. 2 is an enlarged plan view of the spiral grooved transfer roller.
Figure 3:
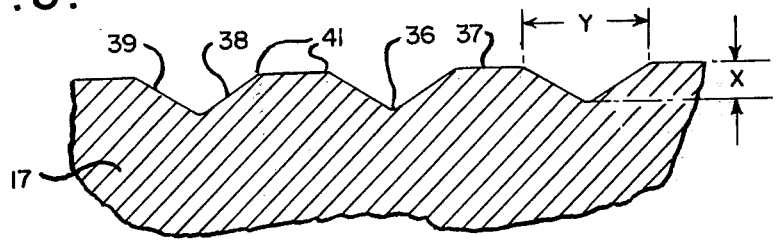
FIG. 3 is a greatly enlarged, fragmentary sectional view illustrating details of the spiral grooves.

In accordance with this invention the transfer roller 17 is provided over its entire peripheral surface with minute, closely spaced, spiral grooves 36, see FIG. 2, whereby the surface area of the roller is substantially increased. Each groove is continuous from one end of the roller to the other and they are formed at a helix or spiral angle within the range of ½° to 15° with the smaller angles being preferred. Between 150 to 200 grooves are generated per inch of roller length and in the preferred form each groove has a depth X, see FIG. 3, between 0.0005 and 0.0015 inch and a width Y at the roller surface of about 0.002 inch. A correspondingly spiralled surface portion 37 of the roller separates the respective grooves and the width of these spiral bands is approximately 0.003 to 0.005 inch.

Although some minor variations in the foregoing dimensions are permissible, it is essential that the grooves 36 and the width of the surface bands 37 therebetween be precisely uniform and equally spaced throughout the entire length of the roller. Moreover, the side walls 38 and 39 of the grooves and the intervening surface bands 37 of the roller should be smooth and treated so as to render them hydrophilic and all edges such as 41 at the junctions of the groove walls and the roller surface should be rounded off to eliminate any sharp edges.

It might be expected that by providing grooves in the surface thereof, the transfer roller would have a tendency to transfer fluid to the applicator roller in the form of discrete beads or ridges rather than as a uniform thin film. Any such tendency however, is substantially offset by the spiral nature of the grooves which causes the fluid to be distributed in a continuous overlapping manner such that it naturally forms into a uniformly level film. Moreover, any tendency for the fluid to remain in bead form as it leaves the transfer/applicator roller nip is avoided by providing the narrow surface bands 36 between the grooves. These surface areas, being hydrophilic, transfer a film of fluid to the applicator roller as they pass through the nip thereby wetting the coacting surface areas of the applicator roller. Upon leaving the nip, the fluid transferred from the grooves 36 will have a natural tendency to seek a common level and this function is greatly facilitated by the adjacent wetted areas of the applicator roller. The beads of fluid, therefore immediately spread laterally over the adjacent, wetted areas of the applicator roller, which spreading action is further facilitated by the rounded edges 41 of the grooves, and form into a continuous film of uniform thickness prior to reaching the printing plate.

It has also been found that the spiral grooved transfer roller is significantly less sensitive to changes in press speed than the conventional smooth roller. The precise reason for the reduced sensitivity is not fully understood but it is believed that the grooves function as reservoirs which normally provide an excess of fluid at the transfer/applicator roller nip and the amount of fluid transferred is dependent upon the relative speeds and the hydrodynamic effect between the respective rollers.

Once the surface speed of the transfer roller is established for a given press speed, it is presumed that approximately 50% of the available fluid is transferred from the transfer roller to the applicator roller. Thereafter, if the press speed and thus the applicator roller speed is reduced, the hydrodynamic effect is such that proportionately less fluid is transferred and more is retained in the transfer roller grooves. On the other hand, as the speed of the press and applicator roller is increased, more fluid is withdrawn from the grooves due to the increased hydrodynamic effect and the demand for more fluid is automatically satisfied. Regardless of the precise reason, therefore, the reduced sensitivity of the dampener represents a further significant advantage by eliminating the need for compensating adjustments of the dampener speed each time a minor adjustment of press speed is effected.

A further important function of the spiral grooved transfer roller resides in its inherent ability to work the ink which accumulates on the applicator roller and distribute it evenly over the entire surface thereof. This is essential in order to consistently transfer a uniform film of dampening fluid over the entire surface of the printing plate and it eliminates the need for an auxiliary oscillator roller which has been required for this purpose heretofore.

From the foregoing description it will be evident that the improved spiral grooved transfer roller not only has broadened the field of use of continuous type dampeners to include rotary newspaper presses, but it has succeeded in reducing the sensitivity of such dampeners whereby the need for frequent adjustments of the dampener each time the press speed is adjusted is substantially reduced. Moreover, the spiral grooved transfer roll serves as a distributer roller for the ink which collects on the applicator roller thereby eliminating the need for an auxiliary oscillator roller for this purpose.

It is to be understood that whereas a preferred embodiment of the invention has been illustrated and described herein, modifications thereof will be obvious to persons skilled in the art without departing from the scope of the invention. For example, it is not essential to employ a form dampening or applicator roller separate and apart from the inking mechanism. The grooved transfer roller can be arranged to coact directly with the first form inking roller or any other convenient roller of the inking mechanism without materially affecting its dampening function. Moreover, four or more rollers may be employed in the dampening train, with additional slip nips and drive units if desired and in such case the improved, grooved transfer roller may be positioned in the fountain 21 and serve to supply a metered amount of water to the next adjacent roller of the dampening train.

I claim:

1. A mechanism for dampening a plate on the plate cylinder of a lithographic printing press comprising a reservoir of dampening fluid spaced from said plate cylinder, roller means for transferring a continuous supply of dampening fluid in the form of a thin film from said reservoir to the plate on said plate cylinder including at least one roller having a smooth, continuous, resilient surface, a transfer roller journalled parallel to said one roller with the surface of said transfer roller being in contact and forming a coacting nip with said one roller, the surface of said transfer roller being metallic and hydrophilic and having closely spaced, continuous, spiral grooves formed therein, means for driving said one roller at a surface speed equal to the surface speed of said plate cylinder, and separate means for rotating said transfer roller at variable surface speeds different from the surface speed of said one roller to thereby meter the volume of dampening fluid transferred from said transfer roller to the surface of said one roller as the latter leaves the said nip.

2. A dampening mechanism as set forth in claim 1 further including a second roller having a smooth, continuous, resilient surface, said second roller being partially immersed in the dampening fluid in said reservoir and serving to convey fluid from the reservoir to said transfer roller, and means for driving said second roller at a different surface speed with respect to that of the transfer roller.

* * * * *

UNITED STATES PATENT AND TRADEMARK OFFICE

CERTIFICATE OF CORRECTION

PATENT NO. : 4,016,811
DATED : April 12, 1977

INVENTOR(S) : Eugene N. Zavodny

It is certified that error appears in the above-identified patent and that said Letters Patent are hereby corrected as shown below:

Column 2, Line 66, following "by" delete "im-" and insert --in- --.

Column 4, Line 45, delete "36" and insert -- 37 --.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*